United States Patent [19]

Soeda et al.

[11] 4,078,507

[45] Mar. 14, 1978

[54] ELECTRICALLY DRIVEN SEWING MACHINE CONTROL APPARATUS

[75] Inventors: Katsuji Soeda; Fumio Sakuma; Mitsuhiro Oyama, all of Sukagawa, Japan

[73] Assignee: Yamamoto Electric Industrial Co. Inc., Japan

[21] Appl. No.: 720,380

[22] Filed: Sep. 3, 1976

[30] Foreign Application Priority Data

Sep. 4, 1975 Japan ..... 50-107444

[51] Int. Cl.[2] ..... D05B 69/22

[52] U.S. Cl. ..... 112/275

[58] Field of Search ..... 112/219 A, 121.11, 275; 318/468

[56] References Cited

U.S. PATENT DOCUMENTS

| | | | |
|---|---|---|---|
| 3,209,713 | 10/1965 | Cohen et al. | 112/219 A |
| 3,622,854 | 11/1971 | Imai et al. | 318/468 X |
| 3,780,681 | 12/1973 | Sasaki | 112/219 A |
| 3,987,739 | 10/1976 | Wurst et al. | 112/219 A X |

*Primary Examiner*—Werner H. Schroeder
*Assistant Examiner*—Peter Nerbun
*Attorney, Agent, or Firm*—Armstrong, Nikaido & Marmelstein

[57] ABSTRACT

A motor control apparatus for driving a power sewing machine comprises a main motor circuit for supplying a motor current to a DC motor from an AC power supply through a main switch and a semiconductor element with a control electrode, a controller for controlling the speed of the motor, a first control means for effecting normal stitching by controlling the conduction state of the semiconductor element, a second control means for effecting a single stitch by controlling the conduction state of the semiconductor element, and a means for switching the operation between the first and second control means. The second control means includes a needle position detector means for detecting the needle to reach predetermined positions, a switching means connected in series to the needle position detector means, a trigger voltage supply means for applying a trigger voltage to the control electrode of the semiconductor element, and a switch-operating means. The switch-operating means operates in such a manner that, when the main switch is closed without the depression of the controller, the switching means is closed, while upon the depression of the controller, the switching means is opened for predetermined time and thereafter to close again upon the lapse of said predetermined time. If the needle position detector means detects that the needle has reached the predetermined positions with the switching means closed, the trigger voltage supply means is made ineffective.

3 Claims, 1 Drawing Figure

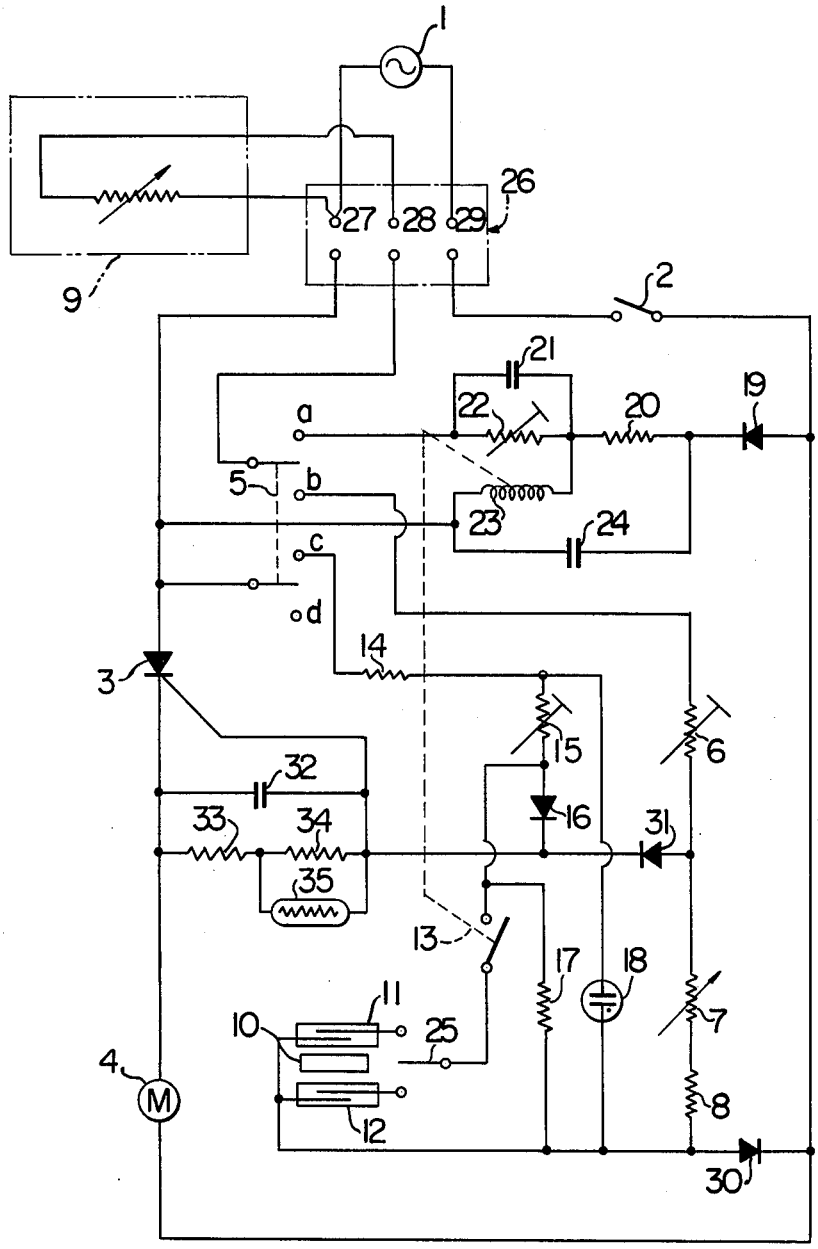
1
26
27
28
29
9
2
21
19
a
22
20
5
b
23
24
c
d
14
3
15
6
32
16
33
34
31
35
13
17
18
11
10
25
7
4
M
8
12
30

ELECTRICALLY DRIVEN SEWING MACHINE CONTROL APPARATUS

BACKGROUND OF THE INVENTION

1. Field of the Invention

This invention relates to a control apparatus of a motor for driving a sewing machine, or more in particular to an improved control apparatus capable of effecting single stitch automatically.

2. Description of the Prior Art

In conventional electrically-driven sewing machines, single stitch for, say, basting requires the manual operation of the fly wheel. Also, in an electrically-drived sewing machine capable of stopping a needle at a designated stop position, it is required to change-over a switch for designating stop positions each time of one-needle stitch. Thus troublesome operations are required in either case.

SUMMARY OF THE INVENTION

An object of the present invention is to eliminate the above-mentioned disadvantages of the conventional electrically-driven sewing machines.

Another object of the present invention is to provide a control apparatus enabling an automatic single stitch by the operation of a speed controller.

According to the present invention, there is provided a control apparatus comprising a needle-position detector means, connected to a trigger voltage supply means for supplying a trigger voltage to a semiconductor element with a control electrode, for rendering the trigger voltage supply means ineffective when the needle reaches a predetermined position, and a switch-operating means for controlling the needle position control means in response to the speed controller, whereby the depression of the controller causes the needle position detector means to be rendered ineffective for a predetermined period of time thereby to automatically effect a single stitch without regard to the needle position.

BRIEF DESCRIPTION OF THE DRAWING

The accompanying single FIGURE of the drawings shows a circuit diagram of an embodiment of the present invention.

DESCRIPTION OF THE PREFERRED EMBODIMENTS

A control apparatus for a motor for driving a power sewing machine according to the present invention is shown in the drawing. An AC power supply 1 is connected to a DC motor 4 through terminals 27 and 29 of a connector 26, a main switch 2 and a semiconductor element with a control electrode such as a thyristor 3. A pedal-type speed controller such as a variable resistor 9 is connected to the terminals 27 and 28 of a connector 26, which are connected to a bipolar double-throw switch 5. The fixed contact *a* of the bipolar double-throw switch 5 is connected to the cathode of a diode 19 through a parallel circuit including a semifixed resistor 22 and a capacitor 21, and a resistor 20. The anode of the diode 19 is connected to the terminal 29 of the connector 26 through the main switch 2. The resistor 20 is connected in parallel to a series circuit including a coil 23 and a capacitor 24. A junction point of the coil 23 and the capacitor 24 is connected to the terminal 27. The fixed contact *b* of the bipolar double-throw switch 5 is connected to the anode of the diode 30 through a semifixed resistor 6, a variable resistor 7 and a resistor 8, while the cathode thereof is connected to the terminal 29 through the main switch 2. A junction point of the semifixed resistor 6 and the variable resistor 7 is connected to the anode of the diode 31, the cathode of which is connected to the gate electrode of the thyristor 3. The fixed contact *c* of the bipolar double-throw switch 5 is connected to the anode of the diode 30 through a resistor 14, a constant-voltage element such as a neon discharge tube 18, which is connected in parallel to a series circuit of a semifixed resistor 15 and a resistor 17. The resistor 17 is connected in parallel to a series circuit including a switch like a reed switch 13, a single-pole double-throw switch 25 and needle position detector means such as reed switches 11 and 12. A junction point between the semifixed resistor 15 and the resistor 17 is connected to the anode of the diode 16, the cathode of which is connected to the gate electrode of the thyristor 3. A capacitor 32 and a series circuit including resistors 33 and 34 are connected between the gate electrode of the thyristor 3 and the cathode thereof. The resistor 34 is connected in parallel to a thermistor 35. The reed switch 13 and the coil 23 make up an electromagnetic relay. A permanent magnet 10 is mounted in interlocked relation with the needle bar (not shown) of the sewing machine. The magnet 10 is interlinked with the needle bar in such a relation that the needle bar is located, for example, at an upper position when the permanent magnet 10 approaches the reed switch 11, and located, for example, at a lower position when it approaches the reed switch 12, wherein the reed switches 11 and 12 are closed in response to the proximity of the permanent magnet 10. The switch 25 is provided for designating a stop position of the needle at an upper or lower position.

The operation of the control circuit according to the present invention will be explained below.

Assume that the bipolar double-throw switch 5 is thrown on the terminals *b* and *d*, i.e., on the first control means side. The resistance values of the semifixed resistor 6 and the resistor 8 are adjusted in such a way that, when the Ac power supply 1 is connected to the controller 9 through the connector 26 without depressing the controller 9, i.e., with the controller 9 at the maximum resistance value thereof and also with the variable resistor 7 at their maximum resistance value, the maximum value of the trigger voltage applied to the thyristor 3, i.e. the voltage across the series circuit of the resistors 7 and 8, is slightly lower than the trigger level of the thyristor 3, so that the thyristor fails to conduct even at a maximum trigger voltage. Under this condition, assume that the connector 26 is connected to the AC power supply 1 and controller 9 with the main switch 2 closed. Since the thyristor 3 is in non-conductive state, no current is supplied to the motor 4, thus maintaining the motor 4 in static state. Namely, assume first that a positive half cycle of the AC power supply 1 begins so that a voltage positive at the terminal 27 and negative at the terminal 29 is applied to the control circuit. Now, the half cycle of the source voltage in such a polarity condition is called herein as a positive half cycle, and the opposite half cycle as a negative half cycle. Since the diode 30 is connected in forward direction with respect to the positive half cycle, the source current flows to the terminal 29 through the controller 9, the terminal 28, the resistors 6, 7 and 8, the diode 30 and through the main switch 2. In the subsequent negative half cycle, the diode 30 is connected in reverse direction, while the diode 19 is connected in forward direction with respect to the negative half cycle, so that the source current flows through the terminal 29, the diode 19, the resistor 20, the coil 23 and the capacitor 24 to the terminal 27.

When the resistance value of the controller 9 is reduced to a predetermined value by depressing it to a predetermined position, the maximum value of the trigger voltage increases and reaches to the trigger voltage level for the thyristor 3. As a result, the thyristor 3 is made conductive at a certain firing angle thereby to supply a positive pulsating current for the first time to the motor 4 to start it. When the controller 9 is further depressed to correspondingly further reduce the resistance value thereof, the trigger voltage applied to the thyristor 3 increases with the result that the firing angle of the thyristor 3 advances and more positive pulsating current is supplied to the motor 4 thereby increasing the speed thereof. In this way, the progressive depression of the controller 9 causes the firing angle of the thyristor 3 to be proportionately advanced, thus making possible continuous speed control of the motor 4 from the start to the high-speed operation. The maximum speed of the motor 4 can be freely regulated by appropriately selecting the resistance value of the variable resistor 7. Incidentally, the thermistor 35 is connected between the gate electrode and the cathode of the thyristor 3 for compensating for the variation in the gate sensitivity of the thyristor 3 with respect to a temperature.

Next, explanation will be made of the case in which the bipolar double-throw switch 5 is thrown on the terminals *a* and *c*, i.e., on the second control means side. In this case, the resistance values of the resistors 14 and 17 and the semifixed resistor 15 are so adjusted that, with the connector 26 connected to the AC power supply 1 and the controller 9, the maximum value of the trigger voltage applied to the thyristor 3, i.e. the voltage across the resistor 17, is slightly higher than the trigger voltage level of the thyristor 3, thus firing the thyristor 3 at a small firing angle to operate the motor 4 at a low speed lacking inertia. Under this condition, assume that the controller 9 and the AC power supply 1 are connected to the connector 26 and that the main switch 2 is closed without depressing the controller 9. First, during the negative half cycle, the source current flows to the terminal 27 through the terminal 29, the main switch 2, the diode 19, the resistor 20, the coil 23 and the capacitor 24 on the one hand and also flows to the terminal 27 through the diode 19, the resistor 20, the capacitor 21, the semifixed resistor 22 and the controller 9 on the other hand. By the way, the capacitor 24 is provided for smoothing the half-wave rectified current. The current passed through the resistor 20 is divided into two paths, one to the coil 23, and the other to a parallel circuit including the capacitor 21 and the resistor 22. When the controller 9 is not depressed, however, the resistance value of the circuit including the controller 9, the capacitor 21 and the resistor 22 is larger than that of the coil 23 so that most of the source current flows through the coil 23. The exciting current flowing through the coil 23 is of a sufficient value to close the switch 13 thereby closing the switch 13. When the positive half cycle starts subsequently, since the diode is connected in reverse direction, the source current flows from the terminal 27 into the resistor 14. Now, the coil 23 is continuously excited by the current smoothed by the capacitor 24 even during the positive half cycle, thus keeping the switch 13 closed during the positive half cycle. If, for example, the switch 25 is thrown on the reed switch 11 side and the permanent magnet 10 is in proximity to the reed switch 11 with the needle at its upper designated position, a current path composed of the switches 13, 25 and the reed switch 11 is provided. As a result, the resistor 17 for supplying the trigger voltages to the gate electrode of the thyristor 3 is short-circuited, thus the means for providing the trigger voltage is made ineffective to keep the motor 4 in static state.

Now, even when the switch 25 is thrown on the reed switch 11 side, if the permanent magnet 10 is not in proximity to the reed switch 11, namely, when the needle is not at the upper designated position, the reed switch 11 is open, so that the circuit including the switches 13, 25 and 11 is also in open state. Therefore, the positive source current flows to the diode 30 through the resistor 14 and the neon tube 18 on one hand and through the resistor 14, the resistors 15 and 17 on the other hand. The trigger voltage, i.e., the voltage across the resistor 17, is applied to the thyristor 3 thereby starting the motor 4 at a low speed lacking inertia. With the rotation of the motor 4, the permanent magnet 10 goes away from the reed switch 11 and approaches the reed switch 12, and then approaches the reed switch 11 again thereafter to close the reed switch 11. Thereby, the current path composed of the switches 13, 25 and 11 is provided, thus short-circuiting the resistor 17 to thereby stop the motor 4 with the permanent magnet 10 held in proximity to the reed switch 11. Incidentally, the neon discharge tube 18 is provided for maintaining the trigger voltage at a constant value, i.e., the voltage across the resistor 17 thereby to damp the variation in the firing angle of the thyristor 3 against the variation in the source voltage.

Next, assume that the controller 9 is depressed to the predetermined position thereby reducing the resistance value thereof almost to zero, the instantaneous resistance value of the circuit including the controller 9, the capacitor 21 and the semifixed resistor 22 is reduced below the resistance value of the coil 23, so that the source current flowing through the coil 23 decreases and becomes insufficient for closing the switch 13, thus opening the same. The capacitor 21, on the other hand, begins to be charged up to the voltage nearly equal to that across the coil 23. Now, the circuit including the switches 13 and 25 and the reed switch 11 is in open state, so that current flows through the resistor 17 and a trigger voltage, i.e., the voltage across the resistor 17 is applied to the thyristor 3, thus starting the motor 4 at low speed. With the rotation of the motor, the magnet 10 begins to move away from the reed switch 11. The capacitor 21 continues to be gradually charged in accordance with a time constant determined by the capacitance of the capacitor 21 and the resistance of the resistor 22, until the voltage across the capacitor 21 reaches the voltage nearly equal to that across the coil 23. According as the voltage across the capacitor 21 approaches the voltage across the coil 23, the current flowing into the capacitor 21 decreases, whereas the exciting current flowing through the coil 23 increases again to such a degree sufficient to close the switch 13, thus closing the same. Subsequently, when the voltage across the capacitor 21 reaches nearly the voltage across the coil 23, the negative source current stops flowing into the capacitor 21 and most of the negative source current flows through the coil 23. Thereafter, the magnet 10 gradually approaches the reed switch 11, and when the reed switch 11 is closed by the proximity of the magnet 10, the current path composed of the switches 13, 25 and 11 is provided to thereby short-circuiting the resistor 17. With the short-circuit of the resistor 17, the trigger voltage supply means is thus made ineffective and the thyristor 3 is turned off to stop the motor 4. In other words, until the predetermined time determined by the time constant dependent on the capacitance of the capacitor 21 and the resistance of the resistor 22 passes after the depression of the controller 9 to the predetermined position, the switch 13 is kept open by the energization of the coil 23, and closed again after passage of the predetermined time. The single stitch is attained when the predetermined time is set within the time which is required for the motor-driven needle to reciprocate from and to a designated position, for instance, the upper position. By the way, the resistor 22 is provided for effecting the discharge of the capacitor promptly when discharging the capacitor 21 by releasing the controller 9.

Further, even if the controller 9 is depressed when the capacitor 21 is not fully discharged to be at a certain potential, little source current flows into the capacitor 21 and the current flowing through the coil 23 is not substantially reduced, so that the reed switch 13 continues to close. Therefore, after moving away the magnet 10 from, for example, the reed switch 11 by depressing the controller 9, if the controller 9 is kept depressed or it is depressed again when the magnet 10 approaches again the reed switch 11, the switch 13 is closed certainly thereby to provide no trigger voltage to the thyristor 3 to stop the motor 4. The single-stitching operation is thus assured, preventing any error operation involving two or more stitches. Now, the next single-stitching is attained by depressing the controller 9 again after the complete discharge of the capacitor 21 by the release of the controller 9.

Furthermore, in the control circuit according to the present invention, the thyristor 3 may be replaced by a bi-directional triod thyristor, and the motor 4 may takes the form of an AC motor, with equal effect.

It will be understood from the foregoing description that the control circuit according to the present invention enables the single-stitching operation automatically and accurately only by the operation of the controller.

We claim:

1. A control apparatus for a motor for driving a power sewing machine comprising:

a main motor circuit for supplying a motor current to a DC motor from an AC power supply through a main switch and a semiconductor element with a control electrode;

a controller for controlling the speed of said motor, said controller being movable between a first and a second position and normally biased toward said first position and having a first resistor with two terminals, the resistance between said two terminals of said first resistor being continuously changeable between a first and a second value and having said first and second values when said controller is set to said first and second positions respectively, and one of said two terminals of said first resistor being connected to said AC power supply;

first means for producing a first trigger voltage, said first means having an input connected to the other of said two terminals of said first resistor and an output connected to said control electrode of said semiconductor element, and said first trigger voltage being controlled by changing the resistance of said first resistor thereby controlling the firing angle of said semiconductor element;

second means for applying a second trigger voltage to said control electrode of said semiconductor element;

switch means alternatively changeable between a first and a second state, said first and second means being rendered inoperative when said switch means is changed to said first and second states respectively;

needle position detector means adapted to be actuated when a needle reaches predetermined positions;

a time-constant circuit having a second resistor with two terminals and a capacitor, one of said two terminals of said second resistor being connected to said the other terminal of said first resistor, and said capacitor being connected across at least a portion of said second resistor;

a solenoid connected to said time-constant circuit;

rectifier means for rectifying the power voltage of said power supply and applying the rectified power voltage between said one terminal of said first resistor and the other of said two terminals of said second resistor, said rectifier means being actuated when said main switch is closed and said switch means is changed to said first state;

the terminal voltage of said capacitor being set, when said rectifier means is actuated, to a first voltage when said resistance of said first resistor is set to said first value and changing with a predetermined time-constant from said first voltage to a second voltage when said resistance of said first resistor is set to said second value against said biasing force;

said solenoid being actuated during the time in which said terminal voltage of said capacitor changes from said first voltage to said second voltage;

third means for rendering said second means inoperative in response to the actuation of both of said needle position detector means and said solenoid.

2. A control apparatus for a motor for driving a power sewing machine according to claim 1, wherein said first value of said first resistor being higher than said second value thereof, said terminal voltage of said capacitor increasing with a predetermined time-constant from said first voltage to said second voltage higher than said first voltage when said resistance of said first resistor is set to said second value thereby charging said capacitor during the time in which said terminal voltage of said capacitor increases from said first voltage to said second voltage, and said solenoid being actuated while said capacitor is charged.

3. A control apparatus for a motor for driving a power sewing machine according to claim 2, wherein said solenoid being connected across said rectifier means and deenergized while said capacitor is charged.

* * * * *

UNITED STATES PATENT AND TRADEMARK OFFICE

CERTIFICATE OF CORRECTION

PATENT NO. : 4,078,507

DATED March 14, 1978

INVENTOR(S) : KATSUJI SOEDA ET AL

It is certified that error appears in the above-identified patent and that said Letters Patent are hereby corrected as shown below:

Please change the assignee on said patent from "Yamamoto Electric Industrial Co., Inc.", to --Yamamoto Electric Industrial Co., Ltd.--

Signed and Sealed this

*Third* Day of *October 1978*

[SEAL]

*Attest:*

RUTH C. MASON
*Attesting Officer*

DONALD W. BANNER
*Commissioner of Patents and Trademarks*